US011472681B2

(12) United States Patent
Netecke et al.

(10) Patent No.: US 11,472,681 B2
(45) Date of Patent: Oct. 18, 2022

(54) DIRECT DRIVE DRAWWORKS

(71) Applicant: Cameron International Corporation, Houston, TX (US)

(72) Inventors: Michael Raymond Netecke, Spring, TX (US); Rogelio Cabrera, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 149 days.

(21) Appl. No.: 16/934,632

(22) Filed: Jul. 21, 2020

(65) Prior Publication Data

US 2022/0024734 A1 Jan. 27, 2022

(51) Int. Cl.
*B66D 1/12* (2006.01)
*E21B 19/00* (2006.01)

(52) U.S. Cl.
CPC ..... *B66D 1/12* (2013.01); *E21B 19/008* (2013.01); *B66D 2700/025* (2013.01)

(58) Field of Classification Search
CPC . B66D 1/12; B66D 1/14; B66D 1/225; B66D 1/30; B66D 5/02; B66D 5/14; B66D 2700/025; B66D 2700/03; B66D 2700/035; B66D 2700/05; B66D 2700/07; E21B 19/008
See application file for complete search history.

(56) References Cited

U.S. PATENT DOCUMENTS 4,132,387 A * 1/1979 Somerville ..... B66D 1/52 254/340
5,625,262 A * 4/1997 Lapota ..... H02P 5/52 318/432
7,934,437 B2 * 5/2011 Biester ..... F16K 31/53 74/89.14
8,596,616 B1 12/2013 Soot
8,820,719 B2 * 9/2014 Ferrari ..... B66D 1/12 254/340
10,106,380 B2 * 10/2018 Hausladen ..... B66D 1/22
2003/0111653 A1 * 6/2003 Heinrichs ..... B66D 1/58 254/342
2004/0163919 A1 8/2004 Kirkwood et al.
(Continued)

FOREIGN PATENT DOCUMENTS

CN 2811252 Y * 8/2006 ..... B66D 1/26
KR 101617174 B1 5/2016

OTHER PUBLICATIONS

International Search Report and Written Opinion issued in International Patent application PCT/US2021/041512 dated Nov. 12, 2021, 11 pages.

*Primary Examiner* — Michael E Gallion
(74) *Attorney, Agent, or Firm* — Kelly McKinney

(57) ABSTRACT

A direct drive drawworks having a first electric motor comprising a first output shaft, a second electric motor comprising a second output shaft, and a drum for storing a flexible line. The drum may be disposed between the first electric motor and the second electric motor. The first output shaft and the second output shaft may each be connected to the drum. The first electric motor and the second electric motor may be collectively operable to rotate the drum. The first output shaft and the second output shaft may be connected to the drum such that the drum rotates at the same speed as the first output shaft and the second output shaft.

16 Claims, 6 Drawing Sheets

(56) References Cited

U.S. PATENT DOCUMENTS

| | | | | |
|---|---|---|---|---|
| 2008/0116432 | A1* | 5/2008 | Folk | E21B 19/008 254/362 |
| 2010/0329905 | A1 | 12/2010 | Williams | |
| 2011/0174540 | A1* | 7/2011 | Ferrari | B66D 1/12 175/27 |
| 2012/0073765 | A1 | 3/2012 | Hontz et al. | |
| 2013/0240808 | A1 | 9/2013 | Williams | |
| 2014/0332204 | A1* | 11/2014 | Aubry | B23P 6/00 166/77.2 |
| 2016/0031686 | A1* | 2/2016 | Kuttel | F16M 7/00 166/66.4 |
| 2016/0083228 | A1* | 3/2016 | Holck | B66C 13/06 414/138.2 |
| 2016/0137466 | A1 | 5/2016 | Eriksson et al. | |
| 2018/0251353 | A1* | 9/2018 | Netecke | H02K 7/14 |
| 2018/0252299 | A1* | 9/2018 | Cave | B66D 1/82 |
| 2019/0233216 | A1* | 8/2019 | Van Holthe Tot Echten | B65G 23/08 |
| 2019/0309583 | A1* | 10/2019 | Netecke | E21B 19/008 |

* cited by examiner

DIRECT DRIVE DRAWWORKS

BACKGROUND OF THE DISCLOSURE

Wells are generally drilled into the ground or ocean bed to recover natural deposits of oil, gas, and other materials that are trapped in subterranean formations. Well construction operations (e.g., drilling operations) are performed at a wellsite by a drilling system (e.g., a drilling rig) having various surface and subterranean equipment operating in a coordinated manner. For example, a top drive located at a wellsite surface can be utilized to rotate and advance a drill string into a subterranean formation to drill a wellbore. The drill string includes a plurality of drill pipes coupled together and terminating with a drill bit. Length of the drill string can be increased by adding additional drill pipes while depth of the wellbore increases. Drilling fluid is pumped from the wellsite surface down through the drill string to the drill bit. The drilling fluid lubricates and cools the drill bit, and carries drill cuttings from the wellbore back to the wellsite surface. The drilling fluid returning to the surface is cleaned and again pumped through the drill string.

The top drive is suspended from a mast via a hoisting system comprising a traveling block, a crown block, and a drawworks storing a flexible line. The crown block is connected to the mast and the traveling block is connected to the top drive. The crown block and traveling block each comprise one or more pulleys or sheaves around which the flexible line is reeved to operatively connect the crown block, the traveling block, and the drawworks. The drawworks selectively imparts tension to the flexible line to lift and lower the top drive, resulting in the vertical movement of the top drive and the drill string connected with the top drive. The drawworks comprises a base (e.g., a skid), a drum, a prime mover, and a gear box operatively connecting the prime mover to the drum. The prime mover is operable to rotate the drum to reel in the flexible line, causing the traveling block and the top drive to move upward. The prime mover is further operable to rotate the drum to reel out the flexible line, causing the traveling block and the top drive to move downward. A gear box has a large moment of inertia that has to be overcome (e.g., accelerated and decelerated) by the prime mover to rotate the drum at an intended speed to raise and lower the top drive at an intended speed.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces a drawworks that includes a first electric motor having a first output shaft, a second electric motor having a second output shaft, and a drum for storing a flexible line. The drum is disposed between the first electric motor and the second electric motor. The first output shaft and the second output shaft are each connected to the drum. The first electric motor and the second electric motor are collectively operable to rotate the drum.

The present disclosure also introduces a drawworks that includes a first electric motor, a second electric motor, and a drum for storing a flexible line. The first electric motor is connected to the drum on a first side of the drum. The second electric motor is connected to the drum on a second side of the drum. The first electric motor and the second electric motor collectively support the weight of the drum. The first electric motor and the second electric motor are collectively operable to rotate the drum.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
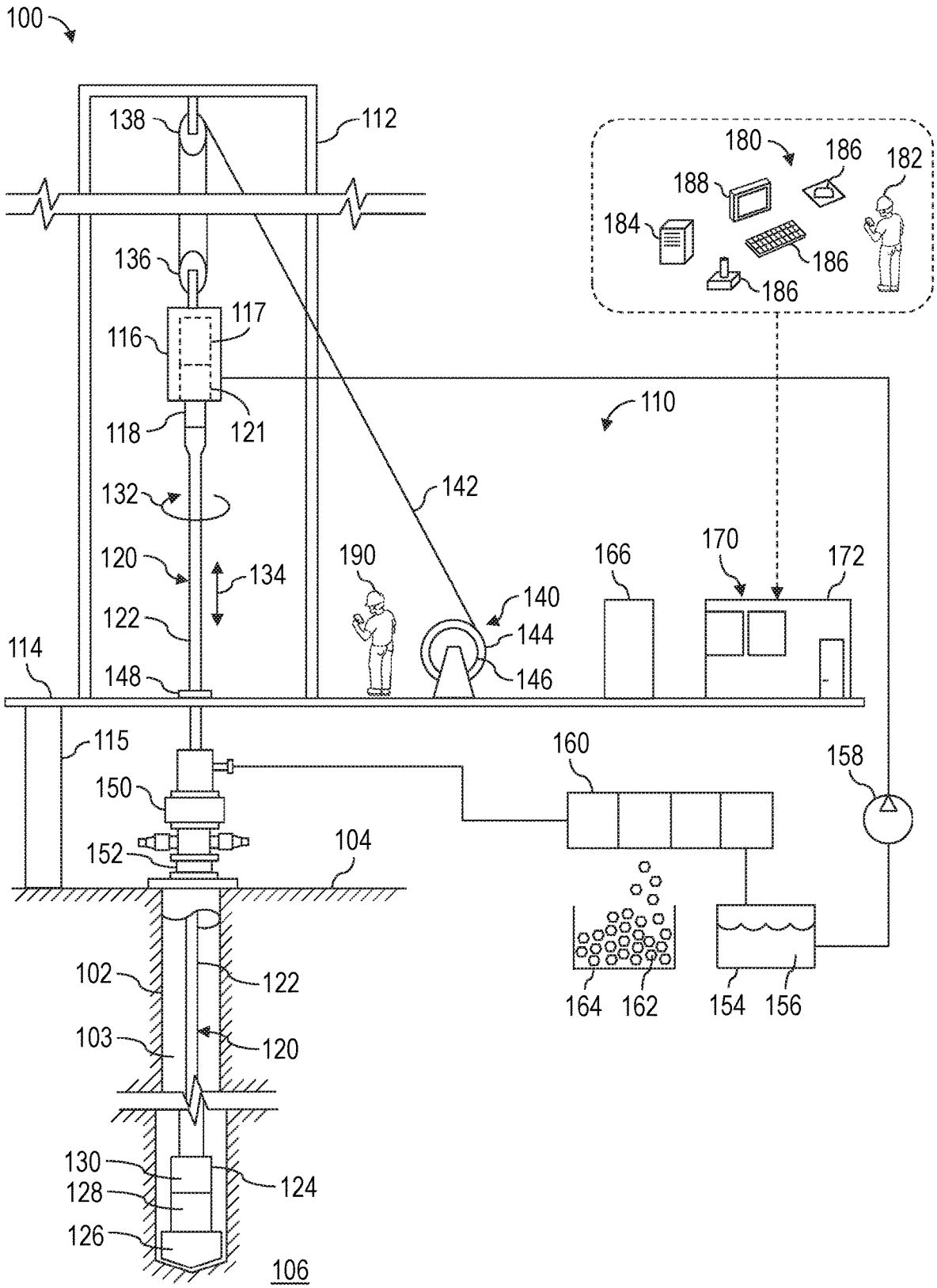
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed.

Systems and methods (e.g., processes, operations, etc.,) according to one or more aspects of the present disclosure may be used or performed in association with a well construction system at a wellsite, such as for constructing a wellbore to obtain hydrocarbons (e.g., oil and/or gas) or other natural resources from a subterranean formation. A person having ordinary skill in the art will readily understand that one or more aspects of systems and methods disclosed herein may be utilized in other industries and/or in association with other systems.

FIG. 1 is a schematic view of at least a portion of an example implementation of a well construction system 100 according to one or more aspects of the present disclosure. The well construction system 100 represents an example environment in which one or more aspects of the present disclosure described below may be implemented. The well construction system 100 may be or comprise a well construction (e.g., drilling) rig operable to construct (e.g., drill)

a wellbore 102 extending from a wellsite surface 104 into a subterranean formation 106 via rotary and/or directional drilling. Although the well construction system 100 is depicted as an onshore implementation, the aspects described below are also applicable or readily adaptable to offshore implementations.

The well construction system 100 comprises well construction equipment, such as surface equipment 110 located at the wellsite surface 104 and a drill string 120 suspended within the wellbore 102. The surface equipment 110 may include a support structure 112 (e.g., a mast or derrick) disposed over a rig floor 114. The drill string 120 may be suspended within the wellbore 102 from the support structure 112. The support structure 112 and the rig floor 114 are collectively supported over the wellbore 102 by legs and/or other support structures (schematically depicted in FIG. 1 by reference number 115).

The drill string 120 may comprise a bottom-hole assembly (BHA) 124 and means 122 for conveying the BHA 124 within the wellbore 102. The conveyance means 122 may comprise drill pipe, heavy-weight drill pipe (HWDP), wired drill pipe (WDP), tough logging condition (TLC) pipe, and/or other means for conveying the BHA 124 within the wellbore 102. A downhole end of the BHA 124 may include or be coupled to a drill bit 126. Rotation of the drill bit 126 and the weight of the drill string 120 may collectively operate to form the wellbore 102. The drill string 120, including the drill bit 126, may be rotated 132 by a top drive 116 connected (perhaps indirectly) with the drill string 120. The top drive 116 may comprise a drive shaft 118 operatively connected with a prime mover (e.g., an electric motor) 117 of the top drive 116, such as via a gear box or transmission 121. The drive shaft 118 may be selectively coupled with the upper end of the drill string 120 (perhaps via a saver sub, not shown) and the prime mover 117 may be selectively operated to rotate 132 the drive shaft 118 and, thus, the drill string 120 coupled with the drive shaft 118. A downhole mud motor 128 operatively connected with the drill bit 126 may also or instead impart the rotational motion 132 to the drill bit 126, such as during slide drilling operations. The BHA 124 may also include one or more downhole tools 130 above and/or below the mud motor 128.

The top drive 116 may be suspended from (supported by) the support structure 112 via a hoisting system operable to impart vertical motion 134 to the top drive 116 and, thus, the drill string 120 connected to the top drive 116. During drilling operations, the top drive 116, in conjunction with operation of the hoisting system, may advance the drill string 120 into the formation 106 to form the wellbore 102.

The hoisting system may comprise a traveling block 136, a crown block 138, and a drawworks 140 storing a flexible line 142 (e.g., a cable, a wire rope, etc.). The crown block 138 may be connected to and thus supported by the support structure 112, and the traveling block 136 may be connected to and thus support the top drive 116. The drawworks 140 may be mounted to the rig floor 114. The crown block 138 and traveling block 136 may each comprise pulleys or sheaves around which the flexible line 142 is reeved to operatively connect the crown block 138, the traveling block 136, and the drawworks 140.

The drawworks 140 may comprise a drum 144 and an electric motor 146 operatively connected with and operable to rotate the drum 144. The drawworks 140 may selectively impart tension to the flexible line 142 to lift and lower the top drive 116, resulting in the vertical movement 134 of the top drive 116 and the drill string 120 (when connected with the top drive 116). For example, the electric motor 146 may be operable to rotate the drum 144 to reel in the flexible line 142, causing the traveling block 136 and the top drive 116 to move upward. The electric motor 146 may be further operable to rotate the drum 144 to reel out the flexible line 142, causing the traveling block 136 and the top drive 116 to move downward.

A set of slips 148 may be located on the rig floor 114, such as may accommodate the drill string 120 during drill string make up and break out operations, drill string running operations, and drilling operations. The slips 148 may be in an open position to permit advancement of the drill string 120 within the wellbore 102 by the hoisting system, such as during the drill string running operations and the drilling operations. The slips 148 may be in a closed position to clamp the upper end (e.g., the uppermost tubular) of the drill string 120 to thereby suspend and prevent advancement of the drill string 120 within the wellbore 102, such as during the make up and break out operations.

The hoisting system may deploy the drill string 120 into the wellbore 102 through fluid control equipment 150 for maintaining well pressure control and controlling fluid being discharged from the wellbore 102. The fluid control equipment 150 may be mounted on top of a wellhead 152 installed over the wellbore 102.

The well construction system 100 may further include a drilling fluid circulation system or equipment operable to circulate fluids between the surface equipment 110 and the drill bit 126 during drilling and other operations. For example, the drilling fluid circulation system may be operable to inject a drilling fluid from the wellsite surface 104 into the wellbore 102 via an internal fluid passage extending longitudinally through the drill string 120. The drilling fluid circulation system may comprise a pit, a tank, and/or other fluid container 154 holding the drilling fluid 156 (i.e., drilling mud). The drilling fluid circulation system may comprise one or more pumps 158 operable to move the drilling fluid 156 from the container 154 into the fluid passage of the drill string 120 via a fluid conduit (e.g., a stand pipe) extending from the pump 158 to the top drive 116 and an internal passage (not shown) extending through the top drive 116.

During drilling operations, the drilling fluid may continue to flow downhole through the internal passage of the drill string 120. The drilling fluid may exit the BHA 124 via ports in the drill bit 126 and then circulate uphole through an annular space 103 of the wellbore 102. In this manner, the drilling fluid lubricates the drill bit 126 and carries formation cuttings uphole to the wellsite surface 104. The drilling fluid flowing uphole toward the wellsite surface 104 may exit the wellbore 102 via one or more instances of the fluid control equipment 150. The drilling fluid may then pass through drilling fluid reconditioning equipment 160 to be cleaned and reconditioned before returning to the fluid container 154. The drilling fluid reconditioning equipment 160 may also separate drill cuttings 162 from the drilling fluid into a cuttings container 164.

The well construction system 100 may further comprise a power supply system 166 configured to supply electrical and mechanical (e.g., fluid) power for actuating or otherwise powering the surface equipment 110, including the drawworks 140. The power supply system 166 may include one or more electric generators, electrical energy storage devices (e.g., batteries, capacitors, etc.), and fuel storage devices, among other examples. The power supply system 166 may also include various means (not shown) for transferring and/or distributing electrical power, mechanical power, and fuel to the well construction equipment and between various pieces of equipment of the power supply system 166, including electric components (power conductors, connectors, relays, etc.) and fluid components (conduits, connectors, valves, etc.), among other examples.

The well construction system 100 may also comprise a control center 170 from which various portions of the well construction system 100, such as the top drive 116, the hoisting system (e.g., the drawworks 140), the power supply system 166, a tubular handling system (e.g., a catwalk, a tubular handling device, etc.), the drilling fluid circulation system (e.g., the mud pumps 158), the drilling fluid cleaning and reconditioning system 160, a well control system (e.g., the fluid control valves 150, a choke manifold, etc.), and the BHA 124, among other examples, may be monitored and controlled. The control center 170 may be located on the rig floor 114 or another location of the well construction system 100, such as the wellsite surface 104. The control center 170 may comprise a facility 172 (e.g., a room, a cabin, a trailer, etc.) containing a control workstation 180, which may be operated by rig personnel 182 (e.g., a driller or another human rig operator) to monitor and control various wellsite equipment or portions of the well construction system 100. However, certain pieces of the surface equipment 110 may also or instead be manually operated (e.g., by hand, via a local control panel, etc.) by rig personnel 190 (e.g., a roughneck) located at various portions (e.g., the rig floor 114) of the well construction system 100.

The control device 184 may be located within and/or outside of the facility 172. The control workstation 180 may comprise or be communicatively connected with a control device 184 (e.g., a processing device, an equipment controller, etc.), such as may be operable to receive, process, and output information to monitor operations of and/or provide control to one or more portions of the well construction system 100. For example, the control device 184 may be communicatively connected with the various surface equipment 110 and/or downhole equipment (e.g., the BHA 124) described herein, among other examples, and may be operable to receive signals (e.g., sensor measurements and/or other data) from and transmit signals (e.g., control commands, signals, and/or other data) to the equipment to perform various operations, perhaps including at least a portion of one or more of the operations described herein. The control device 184 may store executable program code, instructions, and/or operational parameters or setpoints, including for implementing one or more aspects of the methods and operations described herein.

The control workstation 180 may be operable for entering or otherwise communicating control commands to the control device 184 by the rig personnel 182, and for displaying or otherwise communicating information from the control device 184 to the rig personnel 182. The control workstation 180 may comprise one or more input devices 186 (e.g., a keyboard, a mouse, a joystick, a touchscreen, etc.) and one or more output devices 188 (e.g., a video monitor, a touchscreen, a printer, audio speakers, etc.). Communication between the control device 186, the input and output devices 186, 188, and the various wellsite equipment may be via wired and/or wireless communication means. However, for clarity and ease of understanding, such communication means are not depicted, and a person having ordinary skill in the art will appreciate that such communication means are within the scope of the present disclosure.

Other implementations of the well construction system 100 within the scope of the present disclosure may include more or fewer components than as described above and/or depicted in FIG. 1. Additionally, various equipment and/or subsystems of the well construction system 100 shown in FIG. 1 may include more or fewer components than as described above and depicted in FIG. 1. For example, various engines, motors, hydraulics, actuators, valves, and/or other components not explicitly described herein may be included in the well construction system 100, and are within the scope of the present disclosure.

Figure 2:
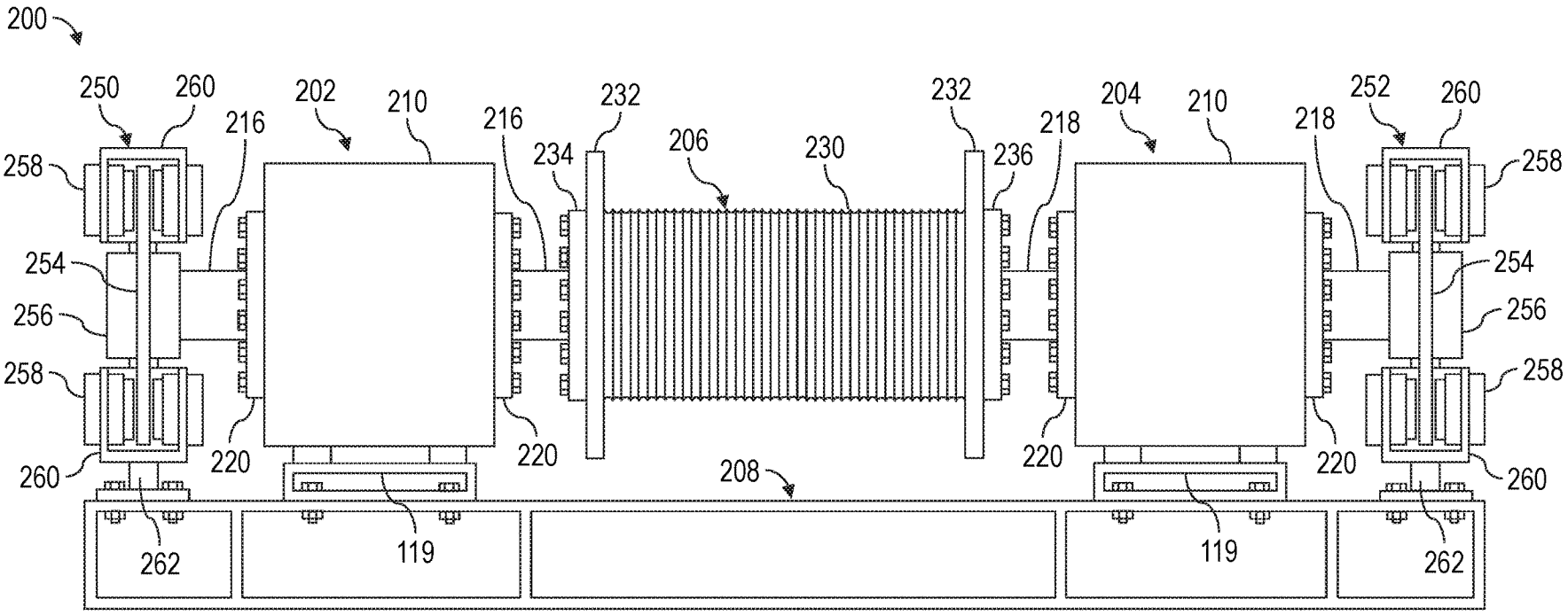
FIG. 2 is a side view of at least a portion of an example implementation of apparatus according to one or more aspects of the present disclosure.
Figure 3:
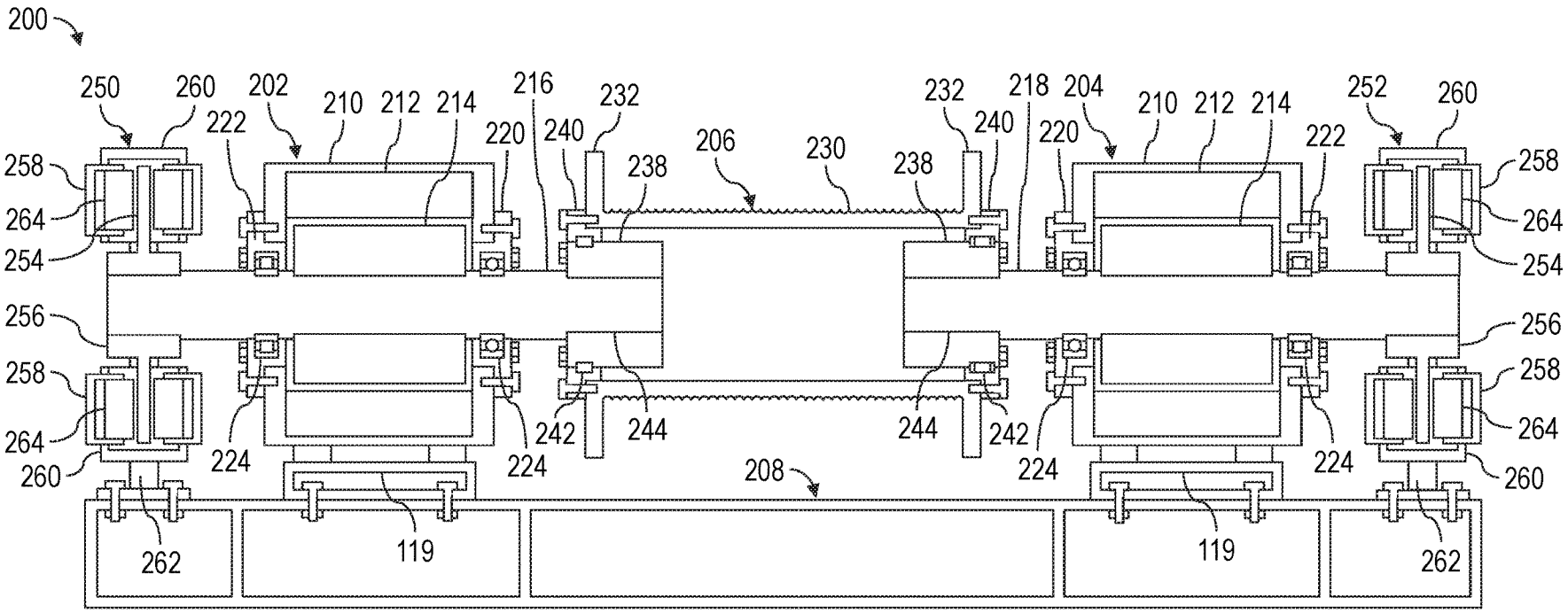
FIG. 3 is a sectional view of the apparatus shown in FIG. 2.

FIGS. 2 and 3 are side and sectional views, respectively, of an example implementation of a drawworks 200 forming a portion of a hoisting system of, or otherwise usable at, the well construction system 100 shown in FIG. 1. The drawworks 200 depicted in FIGS. 2 and 3 is an example implementation of the drawworks 140 shown in FIG. 1. Accordingly, the following description refers the FIGS. 1-3, collectively.

The drawworks 200 comprises a first electric motor 202, a second electric motor 204, and a drum 206 for storing the flexible line 142. Each electric motor 202, 204 may be mechanically or otherwise operatively connected to the drum 206 such that, when operated, the electric motors 202, 204 are collectively operable to rotate the drum 206 to reel in and reel out the flexible line and thereby raise and lower the top drive 116. The electric motors 202, 204 may be fixedly connected to or otherwise supported in position by a base 208. The drum 206 is not directly connected to or directly supported by the base 208, but is connected to and supported in position by the electric motors 204, 206. The base 208 may be connected to or otherwise mounted to the rig floor 114.

Each electric motor 202, 204 may comprise a housing 210, a stator 212, a rotor 214, and a torque output shaft 216, 218. Each housing 210 may encompass the corresponding stator 212 and rotor 214 and at least a portion of the corresponding output shaft 216, 218. Each housing 210 and, thus, each electric motor 202, 204, may be fixedly connected to the base 208 via a corresponding connecting member 119 (e.g., a frame, a mounting bracket, etc.). Each connecting member 119 may be welded, bolted, or otherwise fixedly connected to the base 208.

Each stator 212 may be fixedly connected with a corresponding housing 210, and each rotor 214 may be fixedly connected with a corresponding output shaft 216, 218. Each output shaft 216, 218 may extend axially through a corresponding rotor 214 and out of the housing 210 on one or both sides of the housing 210. Opposing end bearing assemblies 220 may rotatably connect each output shaft 216, 218 to the housing 210. Each set of bearing assemblies 220 may maintain a corresponding output shaft 216, 218 and rotor 214 in predetermined axial and radial positions with respect to the housing 210 while permitting the output shaft 216, 218 and the rotor 214 to rotate with respect to the housing 210 and the stator 212. Each bearing assembly 220 may comprise a hub 222 fixedly connected with the housing 210 via a plurality of fasteners (e.g., bolts). Each bearing assembly 220 may further comprise bearings 224 disposed against or in contact with a corresponding output shaft 216, 218. Each hub 222 may comprise or define a channel extending circumferentially along an inner surface of the hub 222, wherein each channel may accommodate the bearings 224 therein. The bearing assemblies 220 reduce friction between the output shafts 216, 218 and the housings 220, and thus permit rotation of the output shafts 216, 218 with respect to the housings 210.

One of the bearings 224 of each electric motor 202, 204 may be or comprise a fixed (i.e., axial and radial) bearing (e.g., a ball bearing) operable to prevent or inhibit both axial and radial movement of a corresponding portion of the housing 210 with respect to the output shaft 216, 218. The other of the bearings 224 of each electric motor 202, 204 may be or comprise a floating (i.e., radial) bearing (e.g., a roller bearing) operable to prevent or inhibit radial movement and permit limited axial movement of a corresponding portion of the housing 210 with respect to the output shaft 216, 218. For example, the bearing 224 of the bearing assembly 220 located closest to the drum 206 may be implemented as a fixed bearing, and the bearing 224 of the bearing assembly 220 located farthest from the drum 206 may be implemented as the floating bearing.

Each stator 212 may be or comprise a plurality of field coils or windings, such as may generate a magnetic field when powered by electrical current from the power supply system 166. Non-magnetic and/or electrically insulating spacers (not shown) may interpose and/or maintain the windings in position. Each stator 212 may define an axial space containing the rotor 214 and through which the output shaft 216, 218 extends. Each rotor 214 may be or comprise a plurality of permanent magnets disposed around the output shaft 216, 218. Each rotor 214 may instead be or comprise a plurality of field coils or windings disposed around the output shaft 216, 218. Non-magnetic and/or electrically insulating spacers (not shown) may interpose and/or maintain the magnets or windings in position. Each rotor 214 may also or instead comprise magnetic induction members, such as may be made of iron, a magnetic form of stainless steel, or another material comprising strong magnetic properties and, thus, responsive to an electromagnetic driving force generated by the stator 212. Magnetic interaction of each corresponding rotor 214 and stator 212 may cause the rotor 214 to rotate, and thus rotate the corresponding output shaft 216, 218 with respect to the stator 212 and the housing 210. The electric motors 202, 204 within the scope of the present disclosure may include, for example, synchronous and asynchronous electric motors, such as may be operable to rotate at selected speeds.

Each stator 212 may be operable to impart movement to a corresponding rotor 214 and, thus, the output shaft 216, 218, the drum 206, and the top drive 116 in a substantially precise manner. That is, the electrical power for operating the stator 212 and/or the rotor 214 may be supplied and controlled by a motor control device, such as a variable-frequency drive (VFD), which may facilitate a wide range of achievable forces and speeds of the rotor 214. The motor control device may be or form a portion of the control device 184 and/or the power supply system 166. Operation of the motor control device may be automatically controlled by a processing device of the control device 192 and/or the motor control device may be manually controlled by the rig personnel via the control workstation 180.

The drum 206 may comprise a cylindrical spool 230 terminating with ring-shaped flanges 232 at opposing ends thereof. The cylindrical spool 230 may comprise circumferential channels configured to accommodate the flexible line 142 therein. The drum 206 is configured to hold or contain a wound length of the flexible line 142. The output shafts 216, 218 of the electric motors 202, 204 are connected to the drum 206 such that the electric motors 202, 204 can collectively rotate the drum 206. The output shaft 216 of the first electric motor 202 may be connected with the drum 206 of a first side of the drum 206, and the output shaft 218 of the second electric motor 204 may be connected with the drum 206 on a second side of the drum 206. The drum 206 may not comprise or contain its own central support shaft extending axially therethrough or otherwise between opposing ends thereof. However, the output shafts 216, 218 of the electric motors 202, 204 may extend axially into the drum 206 and support the drum 206. For example, the output shaft 216 of the first electric motor 202 may extend axially into the drum 206 on the first side of the drum 206, and the output shaft 218 of the second electric motor 204 may extend axially into the drum 206 on the second side of the drum 206. The output shafts 216, 218 may collectively support the weight of the drum 206 and the flexible line 142 wound thereon. The output shafts 216, 218 may also collectively maintain the drum 206 in position or otherwise inhibit the drum 206 from moving horizontally (e.g., axially) and moving vertically (e.g., being pulled upwardly) when the flexible line is under tension during hoisting operations. The output shafts 216, 218 and the drum 206 may be substantially axially aligned.

The output shafts 216, 218 of the electric motors 202, 204 may be directly coupled or otherwise connected to the drum 206 such that each output shaft 216, 218 and the drum 206 rotate at the same speed. For example, the output shafts 216, 218 may be coupled or otherwise connected to the drum 206 without belts or gears (e.g., transmissions or gearboxes) operatively connected between the drum 206 and the output shafts 216, 218.

The drawworks 200 may further comprise a pair of couplings 234, 236, each operable to connect a corresponding output shaft 216, 218 to the drum 206 and to maintain the drum 206 in a predetermined position along the shafts 216, 218 and with respect to the electric motors 202, 204. Each coupling 234, 236 may inhibit relative rotation between a corresponding output shaft 216, 218 and the drum 206, and thus transmit torque from the output shaft 216, 218 to the drum 206 to facilitate rotation of the drum 206 by the electric motors 202, 204. The first coupling 234 may connect the output shaft 216 of the first electric motor 202 with a first side of the drum 206, and the second coupling 236 may connect the output shaft 218 of the second electric motor 204 with a second side of the drum 206. The first coupling 234 may inhibit radial and axial movement of the drum 206, and the second coupling 236 may inhibit radial movement of the drum 206 and permit limited axial movement of the drum 206. The first coupling 234 may be or comprise a barrel coupling that is axially fixed (i.e., does not permit axial movement), and the second coupling 236 may be or comprise a barrel coupling that is axially free or floating (i.e., permits limited axial movement).

Each coupling 234, 236 may comprise an inner hub 238 (e.g., an inner ring or sleeve), an outer hub 240 (e.g., an outer ring or sleeve) disposed about the inner hub 238, and a plurality of barrels 242 (e.g., cylindrical members) disposed between and engaging the inner and outer hubs 238, 240 to connect the inner and outer hubs 238, 240. The inner hub 238 of each coupling 234, 236 may be fixedly connected with a corresponding output shaft 216, 218, and the outer hub 240 of each coupling 234, 236 may be fixedly connected with an opposing side of the drum 206. For example, the inner hub 238 of each coupling 234, 236 may be fixedly connected with a corresponding output shaft 216, 218 at an area of contact or interface 244 therebetween, such as via interference fit (as depicted), complementary splines or threads, and/or fasteners (e.g., bolts). The outer hub 240 of each coupling 234, 236 may be fixedly connected with a corresponding side (e.g., a flange 232) of the drum 206 via fasteners (e.g., bolts) 243.

Figure 4:
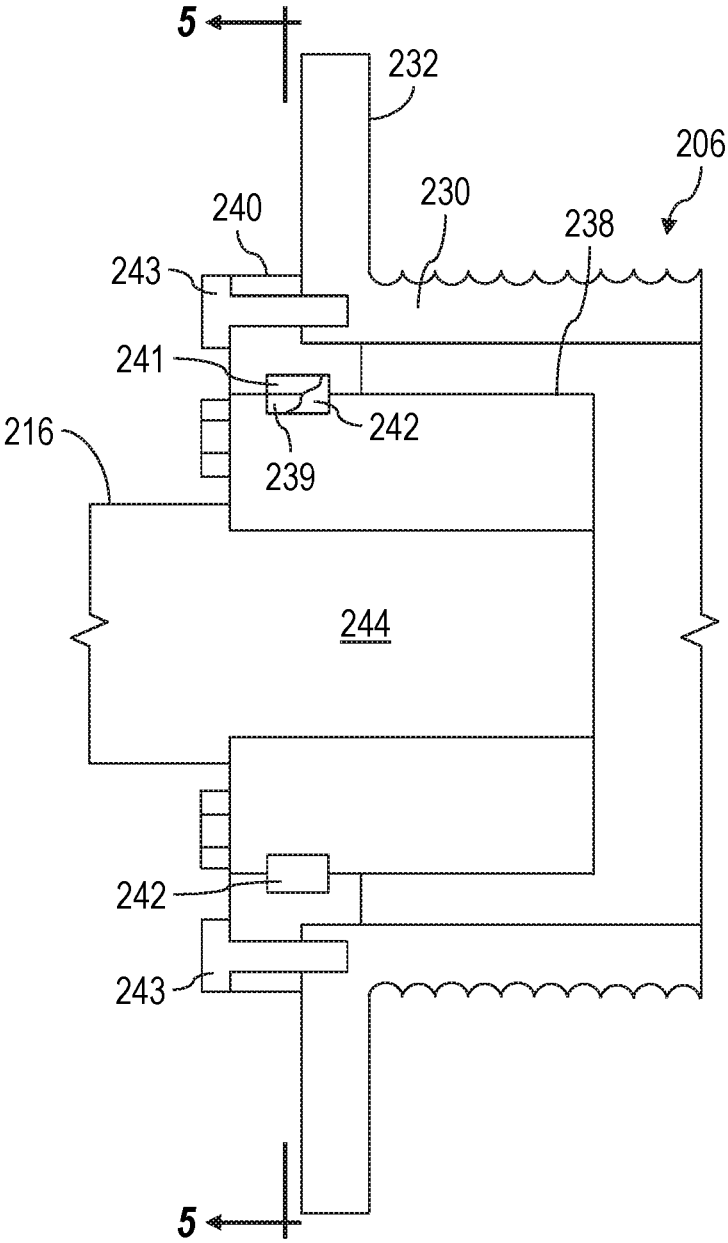
FIG. 4 is an enlarged view of a portion of the apparatus shown in FIG. 3.
Figure 5:
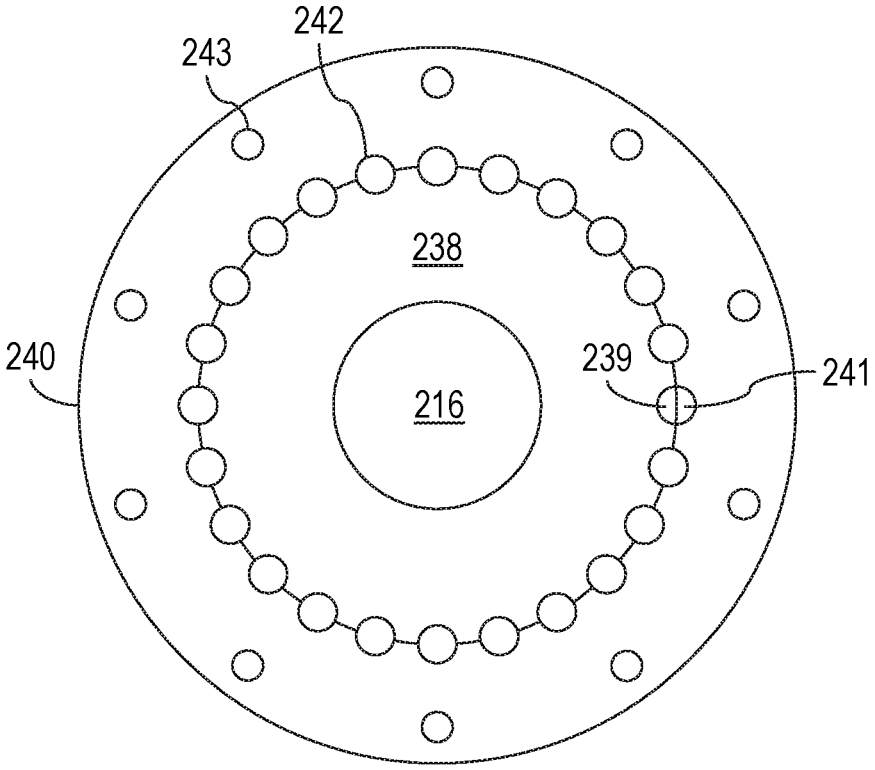
FIG. 5 is a sectional view of a portion of the apparatus shown in FIG. 4.

The inner and outer hubs 238, 240 may be connected together via the barrels 242 to facilitate transfer of torque from the output shafts 216, 218 to the drum 206. For example, as more clearly shown in FIG. 4 (in which one of the barrels 242 is just partially shown) and FIG. 5, the inner hub 238 may comprise a plurality of concave (e.g., semi-cylindrical) cavities 239 forming outwardly extending shoulders or toothing distributed circumferentially along an outer surface or diameter of the inner hub 238. The outer hub 240 may similarly comprise a plurality of concave (e.g., semi-cylindrical) cavities 241 forming inwardly extending shoulders or toothing distributed circumferentially along an inner surface or diameter of the outer hub 240. The concave cavities 239, 241 are aligned, thereby forming a plurality of chambers or pockets each containing a corresponding barrel 242 therein. As shown in FIG. 5 (a sectional view of the inner and outer hubs 238, 240, among other components shown in FIG. 4), each chamber and corresponding barrel 242 may have a generally cylindrical geometry. The barrels 242 may block or otherwise prevent relative rotation between the inner and outer hubs 238, 240 so as to transmit torque from the inner hubs 238 connected with the output shafts 216, 218 to the outer hubs 238 connected with the drum 206. FIG. 5 depicts an example implementation in which 24 barrels 242 are utilized between the hubs 238, 240, although one barrel 242 is not shown in order to demonstrate the cavities 239, 241.

The couplings 234, 236 may operate as articulated joints, permitting limited axial and angular misalignment between the output shafts 216, 218 and the drum 206. Relative size (diameter and/or length) of the barrels 242 and the corresponding chambers 239/241 may be determinative of the amount of permitted axial and angular misalignment between the inner and outer hubs 238, 240 and the amount of permitted axial movement between the inner and outer hubs 238, 240. For example, when outer diameters of the barrels 242 closely match inner diameters of the corresponding chambers, the amount of permitted axial and angular misalignment between the inner and outer hubs 238, 240 may be smaller. As another example, when the length of the barrels 242 closely match length of the corresponding chambers, the amount of permitted axial movement between the inner and outer hubs 238, 240 may be smaller. Thus, the coupling 234 may be configured to permit limited axial and angular misalignment between the output shaft 216 and the drum 206, and to prevent or inhibit axial movement between the output shaft 216 and the drum 206. Furthermore, the coupling 236 may be configured to permit limited axial and angular misalignment between the output shaft 218 and the drum 206, and to permit limited axial movement between the output shaft 218 and the drum 206. The limited angular misalignment between the output shafts 216, 218 and the drum 206 may range between about zero degrees and about five degrees, and the limited axial movement between the output shaft 218 and the drum 206 may range between about zero millimeters and about 25 millimeters, among other examples also within the scope of the present disclosure.

Accordingly, each coupling 234, 236 can inhibit or reduce high bending moment loads to reduce fatigue and early failures of the output shafts 216, 218 and/or the bearing assemblies 220 caused by axial and angular misalignment during assembly of the drawworks 200. Furthermore, permitting limited angular misalignment between the output shafts 216, 218 and the drum 206, and permitting limited axial movement between the output shaft 218 and the drum 206 can inhibit or reduce stresses caused by mechanical changes in the drawworks 200 during hoisting operations. For example, high tensions of the flexible line 142 can bend or flex the drum 206 and/or the output shafts 216, 218, causing angular misalignment between the output shafts 216, 218 and the drum 206. Also, increase in temperature of the flexible line 142, the drum 206, and the output shafts 216, 218 during hoisting operations can cause expansion (e.g., elongation) of the drum 206 and the output shafts 216, 218, which can cause compression stresses between the drum 206 and the output shafts 216, 218. Permitting axial movement between the output shaft 218 and the drum 206 via the coupling 236 can prevent or inhibit such compression stresses from forming.

The drawworks 200 may further comprise one or more brake systems 250, 252 operable to stop or decelerate rotation of the drum 206 and thereby stop or decelerate vertical movement of the top drive 116. Each brake system 250, 252 may be operatively connected to or otherwise associated with each output shaft 216, 218 of the electric motors 202, 204. For example, each brake system 250, 252 may be operatively connected to a corresponding output shaft 216, 218 extending from the housing 210 on a side of the electric motors 202, 204 that is opposite from the side of the electric motors 202, 204 that the drum 206 is located. Thus, the drum 206 may be connected to the output shafts 216, 218 extending on a first side of the electric motors 202, 204, and each brake system 250, 252 may be operatively connected to or otherwise associated with the output shafts 216, 218 extending on a second, opposing side of the electric motors 202, 204.

Each brake system 250, 252 may comprise a brake disc 254 (e.g., brake plate or rotor) extending around and connected with a corresponding output shaft 216, 218 via a hub 256. Each hub 256 may be fixedly connected with a corresponding output shaft 216, 218 via interference fit (as depicted), complementary splines or threads, and/or fasteners (e.g., bolts). Each brake system 250, 252 may comprise a plurality of brake assemblies 258 each operable to apply a braking force to a corresponding brake disc 254 to stop or decelerate rotation of the output shaft 216, 218. Each brake assembly 258 may be or comprise a piston or ram 264 operable to apply the braking force to a corresponding brake disc 254. The brake assemblies 258 may be distributed on opposing sides of each brake disc 254, thereby permitting the braking force to be applied on opposing sides of each brake disc 254. Each brake system 250, 252 may further comprise one or more calipers 260 configured to maintain or support the brake assemblies 258 in position adjacent to a corresponding brake disc 254. Each caliper 260 may be or comprise a beam or frame extending along and/or partially around the brake disc 254. Each caliper 260 and the associated brake assemblies 258 may be fixedly connected to the base 208 via a connecting member 262 (e.g., a frame, a mounting bracket, etc.). The connecting member 262 may be welded, bolted, or otherwise fixedly connected to the base 208. Each brake assembly 258 may be fluidly connected to a source of pressurized hydraulic fluid, such as the power supply system 166. Accordingly, each brake assembly 258 can apply a braking force to a corresponding brake disc 254 when the pressurized hydraulic fluid is introduced to the brake assembly 258.

A drawworks (e.g., the drawworks 140, 200) according to one or more aspects of the present disclosure may be utilized at or otherwise implemented in association with a well construction system (e.g., the well construction system 100) at an oil and gas wellsite, such as for constructing a wellbore for extracting hydrocarbons (e.g., oil and/or gas) from a subterranean formation. However, the drawworks may also or instead be utilized at or otherwise implemented in association with other wellsite systems in the oil and gas industry and other industries to perform hoisting operations. For example, the drawworks may be utilized at or otherwise implemented in association with wellsite systems for performing well intervention operations, including wireline, multiline, and slickline operations, among other examples. The drawworks may also or instead be utilized at or otherwise implemented in association with mining sites, building construction sites, and/or other work sites to perform hoisting operations.

Figure 6:
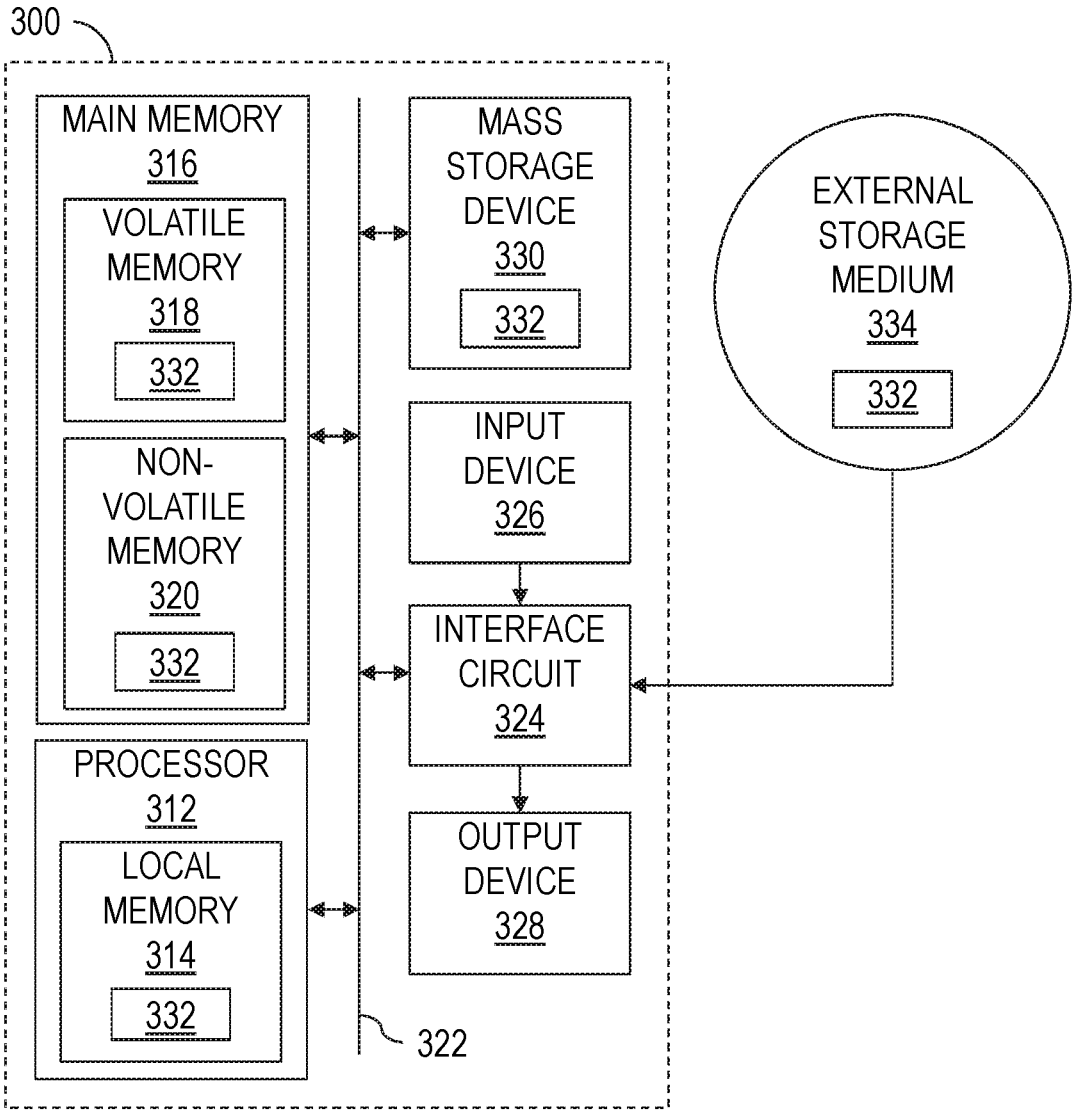
FIG. 6 is a schematic view of at least a portion of an example implementation of apparatus according to one or more aspects of the present disclosure.

FIG. 6 is a schematic view of at least a portion of an example implementation of a processing device 300 (or system) according to one or more aspects of the present disclosure. The processing device 300 may be, form at least a portion of, or be utilized in conjunction with one or more equipment controllers, electronic devices, and/or other devices shown in one or more of FIGS. 1-6. Accordingly, the following description refers to FIGS. 1-6, collectively.

The processing device 300 may be or comprise, for example, one or more processors, controllers, special-purpose computing devices, PCs (e.g., desktop, laptop, and/or tablet computers), personal digital assistants, smartphones, industrial PCs (IPCs), programmable logic controllers (PLCs), servers, internet appliances, and/or other types of computing devices. One or more portions and/or instances of the processing device 300 may be or form at least a portion of the control device 184 (e.g., a processing device, a VFD, etc.), the power supply system 166, and/or the control workstation 180. Although it is possible that the entirety of the processing device 300 is implemented within one device, it is also contemplated that one or more components or functions of the processing device 300 may be implemented across multiple devices, some or an entirety of which may be at the wellsite and/or remote from the wellsite.

The processing device 300 may comprise a processor 312, such as a general-purpose programmable processor. The processor 312 may comprise a local memory 314, and may execute machine-readable and executable program code instructions 332 (i.e., computer program code) present in the local memory 314 and/or another memory device. The processor 312 may be, comprise, or be implemented by one or more processors of various types suitable to the local application environment, and may include one or more of general-purpose computers, special-purpose computers, microprocessors, digital signal processors (DSPs), field-programmable gate arrays (FPGAs), application-specific integrated circuits (ASICs), and processors based on a multi-core processor architecture, as non-limiting examples. Examples of the processor 312 include one or more INTEL microprocessors, microcontrollers from the ARM and/or PICO families of microcontrollers, and embedded soft/hard processors in one or more FPGAs.

The processor 312 may execute, among other things, the program code instructions 332 and/or other instructions and/or programs to implement aspects of the example methods and/or operations described herein. For example, the program code instructions 332, when executed by the processor 312 of the processing device 300, may cause the processor 312 to receive and process (e.g., compare) sensor data (e.g., sensor measurements). The program code instructions 332, when executed by the processor 312 of the processing device 300, may output control data (i.e., control commands) to cause one or more portions or pieces of well construction equipment of the well construction system 100, including the drawworks 140, 200, to perform the example methods and/or operations described herein. For example, the program code instructions 332, when executed by the processor 312 of the processing device 300, may output electrical power to one or more of the electric motors 202, 204 to perform aspects of the example methods and/or operations described herein.

The processor 312 may be in communication with a main memory 316, such as may include a volatile memory 318 and a non-volatile memory 320, perhaps via a bus 322 and/or other communication means. The volatile memory 318 may be, comprise, or be implemented by random access memory (RAM), static RAM (SRAM), dynamic RAM (DRAM), synchronous DRAM (SDRAM), RAMBUS DRAM (RDRAM), and/or other types of RAM devices. The non-volatile memory 320 may be, comprise, or be implemented by read-only memory, flash memory, and/or other types of memory devices. One or more memory controllers (not shown) may control access to the volatile memory 318 and/or non-volatile memory 320.

The processing device 300 may also comprise an interface circuit 324, which is in communication with the processor 312, such as via the bus 322. The interface circuit 324 may be, comprise, or be implemented by various types of standard interfaces, such as an Ethernet interface, a universal serial bus (USB), a third generation input/output (3GIO) interface, a wireless interface, a cellular interface, and/or a satellite interface, among others. The interface circuit 324 may comprise a graphics driver card. The interface circuit 324 may comprise a communication device, such as a modem or network interface card to facilitate exchange of data with external computing devices via a network (e.g., Ethernet connection, digital subscriber line (DSL), telephone line, coaxial cable, cellular telephone system, satellite, etc.).

The processing device 300 may be in communication with various sensors, video cameras, actuators, processing devices, equipment controllers, and other devices of the well construction system via the interface circuit 324. The interface circuit 324 can facilitate communications between the processing device 300 and one or more devices by utilizing one or more communication protocols, such as an Ethernet-based network protocol (such as ProfiNET, OPC, OPC/UA, Modbus TCP/IP, EtherCAT, UDP multicast, Siemens S7 communication, or the like), a proprietary communication protocol, and/or another communication protocol.

One or more input devices 326 may also be connected to the interface circuit 324. The input devices 326 may permit the rig personnel to enter the program code instructions 332, which may be or comprise control data, operational parameters, operational set-points, a well construction plan, and/or a database of operational sequences. The program code instructions 332 may further comprise modeling or predictive routines, equations, algorithms, processes, applications, and/or other programs operable to perform example methods and/or operations described herein. The input devices 326 may be, comprise, or be implemented by a keyboard, a mouse, a joystick, a touchscreen, a track-pad, a trackball, an isopoint, and/or a voice recognition system, among other examples. One or more output devices 328 may also be connected to the interface circuit 324. The output devices 328 may permit for visualization or other sensory perception of various data, such as sensor data, status data, and/or other example data. The output devices 328 may be, comprise, or be implemented by video output devices (e.g., a liquid crystal display (LCD), a light-emitting diode (LED) display, a cathode ray tube (CRT) display, a touchscreen, etc.), printers, and/or speakers, among other examples. The one or more input devices 326 and the one or more output devices 328 connected to the interface circuit 324 may, at least in part, facilitate one or more human-machine interfaces (HMIs).

The processing device 300 may comprise a mass storage device 330 for storing data and program code instructions 332. The mass storage device 330 may be connected to the processor 312, such as via the bus 322. The mass storage device 330 may be or comprise a tangible, non-transitory storage medium, such as a floppy disk drive, a hard disk drive, a compact disk (CD) drive, and/or digital versatile disk (DVD) drive, among other examples. The processing device 300 may be communicatively connected with an external storage medium 334 via the interface circuit 324. The external storage medium 334 may be or comprise a removable storage medium (e.g., a CD or DVD), such as may be operable to store data and program code instructions 332.

As described above, the program code instructions 332 may be stored in the mass storage device 330, the main memory 316, the local memory 314, and/or the removable storage medium 334. Thus, the processing device 300 may be implemented in accordance with hardware (perhaps implemented in one or more chips including an integrated circuit, such as an ASIC), or may be implemented as software or firmware for execution by the processor 312. In the case of firmware or software, the implementation may be provided as a computer program product including a non-transitory, computer-readable medium or storage structure embodying computer program code instructions 332 (i.e., software or firmware) thereon for execution by the processor 312. The program code instructions 332 may include program instructions or computer program code that, when executed by the processor 312, may perform and/or cause performance of example methods, processes, and/or operations described herein.

The present disclosure is further directed to example methods (e.g., operations and/or processes) of performing drilling and other well construction operations with the top drive 116 and the drawworks 140, 200. The methods may be performed by utilizing or otherwise in conjunction with at least a portion of one or more implementations of one or more instances of the apparatus shown in one or more of FIGS. 1-6, and/or otherwise within the scope of the present disclosure. The methods may be caused to be performed, at least partially, by a processing device, such as the processing device 300 executing program code instructions according to one or more aspects of the present disclosure. Thus, the present disclosure is also directed to a non-transitory, computer-readable medium comprising computer program code that, when executed by the processing device, may cause such processing device to perform the example methods described herein. The methods may also or instead be caused to be performed, at least partially, by a human wellsite operator utilizing one or more portions and/or instances of the apparatus shown in one or more of FIGS. 1-6, and/or otherwise within the scope of the present disclosure. However, the methods may also be performed in conjunction with implementations of apparatus other than those depicted in FIGS. 1-6 that are also within the scope of the present disclosure.

In view of the entirety of the present disclosure, including the figures and the claims, a person having ordinary skill in the art will readily recognize that the present disclosure introduces an apparatus comprising a drawworks that comprises: a first electric motor comprising a first output shaft; a second electric motor comprising a second output shaft; and a drum for storing a flexible line, wherein the drum is disposed between the first electric motor and the second electric motor, wherein the first output shaft and the second output shaft are each connected to the drum, and wherein the first electric motor and the second electric motor are collectively operable to rotate the drum.

The drum may not comprise a central shaft extending between opposing ends of the drum.

The drawworks may not comprise gears or a belt operatively connecting: the first output shaft with the drum; and the second output shaft with the drum.

The first output shaft and the second output shaft may collectively support the weight of the drum.

The first output shaft may be connected to the drum on a first side of the drum, and the second output shaft may be connected to the drum on a second side of the drum.

The first output shaft may extend axially into the drum on a first side of the drum, and the second output shaft may extend axially into the drum on a second side of the drum.

The first output shaft, the drum, and the second output shaft may be axially aligned.

The first output shaft and the second output shaft may be connected to the drum such that the drum rotates at the same speed as the first output shaft and the second output shaft.

The first output shaft may be connected to the drum on a first side of the drum via a first coupling, the first coupling may inhibit radial and axial movement of the drum, the second output shaft may be connected to the drum on a second side of the drum via a second coupling, and the second coupling may inhibit radial movement of the drum and permit axial movement of the drum.

The first output shaft may be connected to the drum via a first barrel coupling, and the second output shaft may be connected to the drum via a second barrel coupling.

The first electric motor may further comprise a first rotor and a first stator, the first output shaft may be connected to the first rotor, the second electric motor may further comprise a second rotor and a second stator, and the second output shaft may be connected to the second rotor.

The drawworks may further comprise a brake system comprising: a brake disc connected to the first output shaft; and a piston operable to apply a braking force to the brake disc to stop rotation of the drum.

The present disclosure also introduces an apparatus comprising a drawworks that comprises: a first electric motor; a second electric motor; and a drum for storing a flexible line. The first electric motor is connected to the drum on a first side of the drum, the second electric motor is connected to the drum on a second side of the drum, the first electric motor and the second electric motor collectively support the weight of the drum, and the first electric motor and the second electric motor are collectively operable to rotate the drum.

The drawworks may not comprise gears or a belt operatively connecting: the first electric motor with the drum; and the second electric motor with the drum.

The first electric motor may comprise a first output shaft, the second electric motor may comprise a second output shaft, and the first output shaft and the second output shaft may collectively support the weight of the drum.

The first electric motor may comprise a first output shaft, the second electric motor may comprise a second output shaft, the first output shaft may extend axially into the drum on a first side of the drum, and the second output shaft may extend axially into the drum on a second side of the drum.

The first electric motor may comprise a first output shaft, the second electric motor may comprise a second output shaft, the first output shaft may be connected to the drum on a first side of the drum, and the second output shaft may be connected to the drum on a second side of the drum. The first output shaft and the second output shaft may be connected to the drum such that the drum rotates at the same speed as the first output shaft and the second output shaft. The first output shaft, the drum, and the second output shaft may be substantially axially aligned. The first output shaft may be connected to the drum via a first coupling, the first coupling may inhibit radial movement of the drum and inhibit axial movement of the drum, the second output shaft may be connected to the drum via a second coupling, and the second coupling may inhibit radial movement of the drum and permit axial movement of the drum.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to permit the reader to quickly ascertain the nature of the technical disclosure. It is submitted with the understanding that it will not be used to interpret or limit the scope or meaning of the claims.

What is claimed is:

1. An apparatus comprising:
a drawworks comprising:
a first electric motor comprising a first output shaft;
a second electric motor comprising a second output shaft; and
a drum for storing a flexible line, wherein the drum is disposed between the first electric motor and the second electric motor, wherein the first output shaft and the second output shaft are each connected to the drum, and wherein the first electric motor and the second electric motor are collectively operable to rotate the drum,
wherein the drum does not comprise a central shaft extending between opposing ends of the drum, and
wherein the drawworks does not comprise gears or a belt operatively connecting:
the first output shaft with the drum; and
the second output shaft with the drum.

2. The apparatus of claim 1 wherein the first output shaft and the second output shaft collectively support the weight of the drum.

3. The apparatus of claim 1 wherein the first output shaft is connected to the drum on a first side of the drum, and wherein the second output shaft is connected to the drum on a second side of the drum.

4. The apparatus of claim 1 wherein the first output shaft extends axially into the drum on a first side of the drum, and wherein the second output shaft extends axially into the drum on a second side of the drum.

5. The apparatus of claim 1 wherein the first output shaft, the drum, and the second output shaft are axially aligned.

6. The apparatus of claim 1 wherein the first output shaft and the second output shaft are connected to the drum such that the drum rotates at the same speed as the first output shaft and the second output shaft.

7. An apparatus comprising:
a drawworks comprising:
a first electric motor comprising a first output shaft;
a second electric motor comprising a second output shaft; and
a drum for storing a flexible line, wherein the drum is disposed between the first electric motor and the second electric motor, wherein the first output shaft and the second output shaft are each connected to the drum, and wherein the first electric motor and the second electric motor are collectively operable to rotate the drum, wherein:
the first output shaft is connected to the drum on a first side of the drum via a first coupling;
the first coupling inhibits radial and axial movement of the drum;
the second output shaft is connected to the drum on a second side of the drum via a second coupling; and
the second coupling inhibits radial movement of the drum and permits axial movement of the drum.

8. The apparatus of claim 1 wherein the first output shaft is connected to the drum via a first barrel coupling, and wherein the second output shaft is connected to the drum via a second barrel coupling.

9. The apparatus of claim 1 wherein:
the first electric motor further comprises a first rotor and a first stator;
the first output shaft is connected to the first rotor;
the second electric motor further comprises a second rotor and a second stator; and
the second output shaft is connected to the second rotor.

10. The apparatus of claim 1 wherein the drawworks further comprises a brake system comprising:
a brake disc connected to the first output shaft; and
a piston operable to apply a braking force to the brake disc to stop rotation of the drum.

11. An apparatus comprising:
a drawworks comprising:
a first electric motor;
a second electric motor; and
a drum for storing a flexible line, wherein:
the first electric motor is connected to the drum on a first side of the drum;
the second electric motor is connected to the drum on a second side of the drum;
the first electric motor and the second electric motor collectively support the weight of the drum; and
the first electric motor and the second electric motor are collectively operable to rotate the drum,
the first electric motor comprises a first output shaft;
the second electric motor comprises a second output shaft;
the first output shaft is connected to the drum on a first side of the drum;
the second output shaft is connected to the drum on a second side of the drum;
the first output shaft is connected to the drum via a first coupling;
the first coupling inhibits radial movement of the drum and inhibits axial movement of the drum;
the second output shaft is connected to the drum via a second coupling; and
the second coupling inhibits radial movement of the drum and permits axial movement of the drum.

12. The apparatus of claim 11 wherein the drawworks does not comprise gears or a belt operatively connecting:

the first electric motor with the drum; and the second electric motor with the drum.

13. The apparatus of claim 11 wherein the first output shaft and the second output shaft collectively support the weight of the drum.

14. The apparatus of claim 11 wherein:

the first output shaft extends axially into the drum on the first side of the drum; and the second output shaft extends axially into the drum on the second side of the drum.

15. The apparatus of claim 11 wherein the first output shaft and the second output shaft are connected to the drum such that the drum rotates at the same speed as the first output shaft and the second output shaft.

16. The apparatus of claim 11 wherein the first output shaft, the drum, and the second output shaft are substantially axially aligned.

* * * * *